US005518077A

United States Patent [19]

Blackman et al.

[11] Patent Number: 5,518,077

[45] Date of Patent: May 21, 1996

[54] ROTARY DRILL BIT WITH IMPROVED CUTTER AND SEAL PROTECTION

[75] Inventors: Mark P. Blackman, Lewisville; Jay S. Bird, Waxahachie; Michael S. Beaton, Cedar Hill, all of Tex.

[73] Assignee: Dresser Industries, Inc., Dallas, Tex.

[21] Appl. No.: 408,740

[22] Filed: Mar. 22, 1995

Related U.S. Application Data

[63] Continuation of Ser. No. 221,841, Mar. 31, 1994, Pat. No. 5,452,771.

[51] Int. Cl.[6] ..... E21B 10/00

[52] U.S. Cl. ..... 175/353; 175/371; 277/96.1

[58] Field of Search ..... 175/353, 371, 175/374, 375, 431, 435; 277/96, 96.1, 96.2

[56] References Cited

U.S. PATENT DOCUMENTS

| | | | |
|---|---|---|---|
| 2,234,197 | 3/1941 | Reed | 175/375 |
| 2,907,551 | 10/1959 | Peter | 175/375 |
| 2,939,684 | 6/1960 | Payne | 175/375 |
| 3,389,761 | 6/1968 | Ott | 175/374 |
| 3,497,942 | 3/1970 | Weiss | 29/470.3 |
| 3,800,891 | 4/1974 | White et al. | 175/374 |
| 3,888,405 | 6/1975 | Jones et al. | 228/2 |
| 3,990,525 | 11/1976 | Penny | 175/337 |
| 4,037,673 | 7/1977 | Justman | 175/371 |
| 4,054,426 | 10/1977 | White | 175/371 |
| 4,067,490 | 1/1978 | Jones et al. | 228/102 |
| 4,098,358 | 7/1978 | Klima | 175/371 |
| 4,102,419 | 7/1978 | Klima | 175/371 |
| 4,249,622 | 2/1981 | Dysart | 175/227 |
| 4,280,571 | 7/1981 | Fuller | 175/337 |
| 4,398,952 | 8/1983 | Drake | 419/18 |
| 4,562,892 | 1/1986 | Ecer | 175/371 |
| 4,593,776 | 6/1986 | Salesky et al. | 175/375 |
| 4,597,456 | 7/1986 | Ecer | 175/371 |
| 4,630,692 | 12/1986 | Ecer | 175/330 |
| 4,679,640 | 7/1987 | Crawford | 175/374 |
| 4,688,651 | 8/1987 | Dysart | 175/371 |
| 4,726,432 | 2/1988 | Scott et al. | 175/375 |
| 4,814,254 | 3/1989 | Naito et al. | 430/203 |
| 4,938,991 | 7/1990 | Bird | 427/190 |
| 5,131,480 | 7/1992 | Lockstedt et al. | 175/374 |
| 5,279,374 | 1/1994 | Sievers et al. | 175/374 |
| 5,341,890 | 8/1994 | Cawthorne et al. | 175/374 |
| 5,348,770 | 9/1994 | Sievers et al. | 427/422 |

*Primary Examiner*—Roger J. Schoeppel
*Attorney, Agent, or Firm*—Baker & Botts

[57] ABSTRACT

A rotary cone drill bit for forming a borehole having a body with an underside and an upper end portion adapted for connection to a drill string. The drill bit rotates around a central axis of the body. A number of angularly-spaced arms are integrally formed with the body and depend therefrom. Each arm has an inside surface with a spindle connected thereto and an outer shirttail surface. Each spindle projects generally downwardly and inwardly with respect to the central axis, has a generally cylindrical upper end portion connected to the inside surface, and has an inner sealing surface within the upper end portion. A number of rotary cone cutters equal to the number of arms are each mounted on one of the spindles. Each of the cutters includes an internal generally cylindrical wall defining a cavity for receiving the spindle, a gap with a generally cylindrical first portion defined between the spindle and cavity wall, an outer sealing surface in the cavity wall concentric with the inner sealing surface, and a seal element spanning the gap and sealing between the inner and outer sealing surfaces. The gap has an opening contiguous with and directed outwardly from the shirttail surface. The rotary cone cutters are preferably composites formed from different types of material.

12 Claims, 3 Drawing Sheets

ROTARY DRILL BIT WITH IMPROVED CUTTER AND SEAL PROTECTION

RELATED APPLICATION

This application is a continuation application of U.S. application Ser. No. 08/221,841, filed Mar. 31, 1994, now U.S. Pat. No. 5,452,771 and entitled "Rotary Drill Bit with Improved Cutter and Seal Protection", by Mark P. Blackman, Jay S. Bird and Michael S. Beaton. This application is related to copending application entitled Rotary Drill Bit With Improved Cutter and Method of Manufacturing Same, Ser. No. 08/221,371 filing date Mar. 31, 1994 (Attorney Docket Number 60220-0117) now U.S. Pat. No. 5,429,200.

TECHNICAL FIELD OF THE INVENTION

This invention relates in general to sealed rotary drill bits used in drilling a borehole in the earth and in particular to protection of the seal and bearing surfaces between the inside of the rotary cutter and the spindle upon which the cutter is mounted.

BACKGROUND OF THE INVENTION

One type of drill used in forming a borehole in the earth is a roller cone bit. A typical roller cone bit comprises a body with an upper end adapted for connection to a drill string. Depending from the lower end portion of the body are a plurality of arms, typically three, each with a spindle protruding radially inward and downward with respect to a projected rotational axis of the body. A cutter cone is mounted on each spindle and supported rotatably on bearings acting between the spindle and the inside of a spindle-receiving cavity in the cutter. On the underside of the body and radially inward of the arms are one or more nozzles. These nozzles are positioned to direct drilling fluid passing downwardly from the drill string toward the bottom of the borehole being formed. The drilling fluid washes away the material removed from the bottom of the borehole and cleanses the cutters, carrying the cuttings radially outward and then upward within the annulus defined between the bit body and the wall of the borehole.

Protection of the bearings which allow rotation of the roller cone cutters can lengthen the useful service life of a bit. Once drilling debris is allowed to infiltrate between the bearing surfaces of the cone and spindle, failure of the drill bit will follow shortly. Various mechanisms have been employed to help keep debris from entering between the bearing surfaces. A typical approach is to utilize an elastomeric seal across the gap between the bearing surfaces of the rotating cutter and its support on the bit. However, once the seal fails, it again is not long before drilling debris contaminates the bearing surfaces via the gap between the rotating cutter and the spindle. Thus, it is important that the seal be fully protected against wear caused by debris in the borehole.

At least two prior art approaches have been employed to protect the seal from debris in the well. One approach is to provide hardfacing and wear buttons on opposite sides of the gap between the spindle support arm and the cutter, respectively, where the gap opens to the outside of the bit and is exposed to debris-carrying well fluid. These buttons slow the erosion of the metal adjacent the gap, and thus prolong the time before the seal is exposed to borehole debris. Another approach is to construct the inner-fitting parts of the cutter and the spindle support arm so as to produce in the gap a tortuous path to the seal that is difficult for debris to follow.

An example of this latter arrangement is disclosed in U.S. Pat. No. 4,037,673.

An example of the first approach is used in a conventional tri-cone drill bit wherein the base of each cone cutter at the juncture of the spindle and the arm is defined at least in part by a substantially frustoconical surface, termed the cone backface. This cone backface is slanted in the opposite direction as the conical surface of the shell or tip of the cutter and includes a plurality of hard metal buttons or surface compacts. The latter are designed to reduce the wear of the frustoconical portion of the backface of the cone on one side of the gap. On the other side of the gap, the tip of the associated support arm is protected by a hardfacing material. For definitional purposes, that portion of the arm which is on the outside of the bit and below the nozzle is referred to as a shirttail surface or simply shirttail. More specifically, in referring to prior art bits, radially outward of the juncture of the spindle with the arm, and toward the outer side of the bit, the lower pointed portion of the shirttail is referred to as the tip of the shirttail or shirttail tip.

During drilling with rotary bits of the foregoing character, debris often collects between the backface of the cone cutter and the wall of the borehole generally within the area where the gap opens to the borehole annulus. As a result, the underside of the edge of the shirttail tip which leads in the direction of rotation of the bit during drilling, i.e., the leading edge, can become eroded. As this erosion progresses, the hardfacing covering the shirttail tips eventually chips off. This chipping exposes underlying softer metal to erosion and thereby shortens the path that debris may take through the gap to the seal. This path shortening ultimately exposes the seal to borehole debris and thereby causes seal failure.

SUMMARY OF THE INVENTION

The present invention contemplates an improved rotary cone drill bit by novel construction of the interfitting relationship between the cone cutters and the respective support arm for each cone cutter so as to better protect against erosion at the clearance gap between each cone cutter and its respective support arm, and thereby better protect the seal which blocks well debris from damaging the associated bearing.

In one aspect of the invention, a support arm and cutter assembly of a rotary rock bit having a body provides superior erosion protection. The assembly includes an arm integrally formed with the body and having an inner surface, a shirttail surface, and a bottom edge. The inner surface and the shirttail surface are contiguous at the bottom edge. A spindle is attached to the inner surface and is angled downwardly with respect to the arm. A portion of the spindle defines an inner sealing surface. The assembly also includes a cutter that defines a cavity with an opening for receiving the spindle. A portion of the cavity defines an outer sealing surface that is concentric with the inner sealing surface. The assembly further includes a seal for forming a fluid barrier between the inner and outer sealing surfaces. A gap has a portion formed between the cavity and the spindle, and has an opening contiguous with the bottom edge.

In a related aspect of the invention, the erosion protection is achieved by removing the tip of the shirttail from the respective support arm and expanding the backface of the associated zone in both radial and axial directions relative to the spindle on which the cone is mounted. As a result, the position of the gap opening is changed, the flow path through the gap between the seal and the gap opening is lengthened and oriented in an upward direction, and the backface of the cone aids in the deflection of well fluid flow away from the gap opening and toward the well annulus.

In another related aspect of the invention, the erosion protection is achieved by shortening the shirttail tip. As a result, the position of the gap opening is changed, the backface of the cone aids in the deflection of well fluid flow away from the gap opening, a first portion of the gap flow path is angled upwardly, and a second portion includes the opening and is angled downwardly.

In another aspect of the invention, a composite cone cutter for use with a rotary cone drill bit is provided with the backface of the cone having a hard metal covering such as hardfacing. Alternatively, a portion of the composite cone including the backface is itself made of hard metal so that the base portion of the composite cone adjacent the gap is highly resistant to both erosion and wear. In accomplishing this, an important and preferred aspect of the invention is the formation of a composite cone for a rotary cone drill bit which is comprised of dissimilar materials normally incompatible with each other under the usual processing steps required for the manufacture of a rotary cone drill bit. Specifically, the cone backface is formed of a hard metal material that is more resistant to erosion and wear than conventional hardfacing materials, and is also incompatible with the usual heat-treating processes to which the main portion or shell of the cone is subjected.

The foregoing and other advantages of the present invention will become more apparent from the following description of the preferred embodiments for carrying out the invention when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
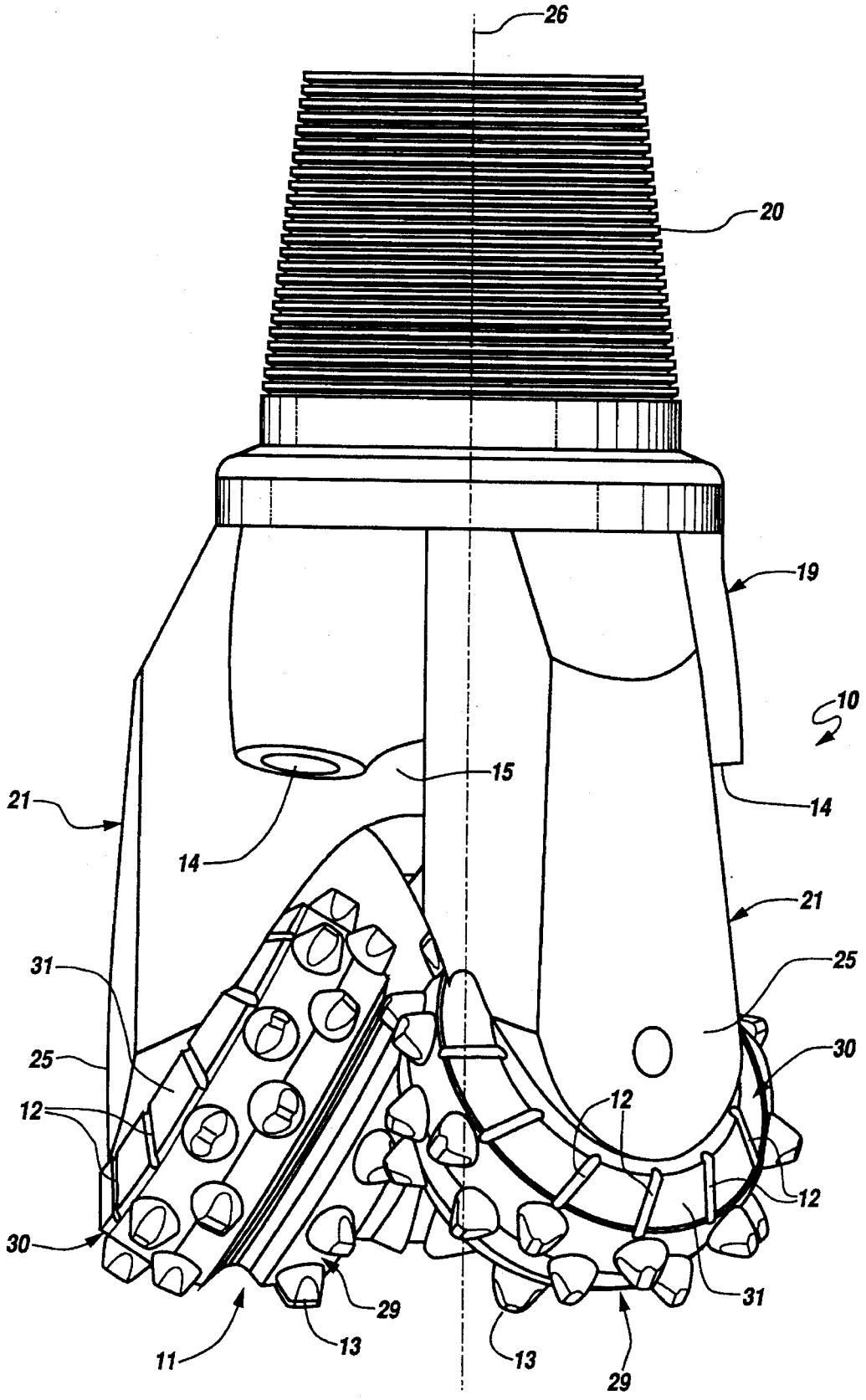
FIG. 1 is an isometric view of a rotary cone drill bit embodying the novel features of the present invention.

The preferred embodiments of the present invention and its advantages are best understood by referring to FIGS. 1–5 of the drawings, like numerals being used for like and corresponding parts of the various drawings.

As shown in the drawings for purposes of illustration, the present invention is embodied in a rotary cone drill bit 10 of the type utilized in drilling a borehole in the earth. Rotary cone drill bit 10 may sometimes be referred to as a "rotary rock bit." With rotary cone drill bit 10, cutting action occurs as cone-shaped cutters 11 are rolled around the bottom of the borehole by rotation of a drill string (not shown) to which bit 10 is attached. Cutters 11 may sometimes be referred to as "rotary cone cutters" or "roller cone cutters."

As shown in FIG. 1, cutters 11 each include cutting edges formed by grooves 12 and protruding inserts 13 which scrape and gouge against the sides and bottom of the borehole under the weight applied through the drill string. The formation of material debris thus created is carried away from the bottom of the borehole by drilling fluid ejected from nozzles 14 (FIG. 1) on underside 15 of bit 10. The debris-carrying fluid generally flows radially outward between underside 15 or exterior of bit 10 and the borehole bottom, and then flows upwardly toward the well head (not shown) through an annulus 16 (FIG. 2) defined between bit 10 and side wall 17 of the borehole. For some applications, spindles 23 may also be tilted at an angle of zero to three or four degrees in the direction of rotation of drill bit 10.

In considering the structure in more detail, bit 10 (FIG. 1) comprises an enlarged body 19 with a tapered, externally-threaded upper section 20 adapted to be secured to the lower end of the drill string. Depending from body 19 are three support arms 21 (two visible in FIG. 1), each with a spindle 23 (FIG. 2) connected to and extending from an inside surface 24 (FIG. 2) thereof and a shirttail outer surface 25. Inside surface 24 and shirttail outer surface 25 are contiguous at the bottom edge of arm 21. Spindles 23 are preferably angled downwardly and inwardly with respect to a central axis 26 of bit body 19 so that as bit 10 is rotated, the exterior of cutters 11 engage the bottom of the borehole. For some applications, spindles 23 may also be tilted at an angle of zero to three or four degrees in the direction of rotation of drill bit 10.

Within the scope of the present invention, each of the three cutters 11 is constructed and mounted on its associated spindle 23 in a substantially identical manner (except for the pattern of the rows of inserts 13). Accordingly, only one of arm 21/cutter 11 assemblies is described in detail, it being appreciated that such description applies also to the other two arm-cutter assemblies.

Figure 2:
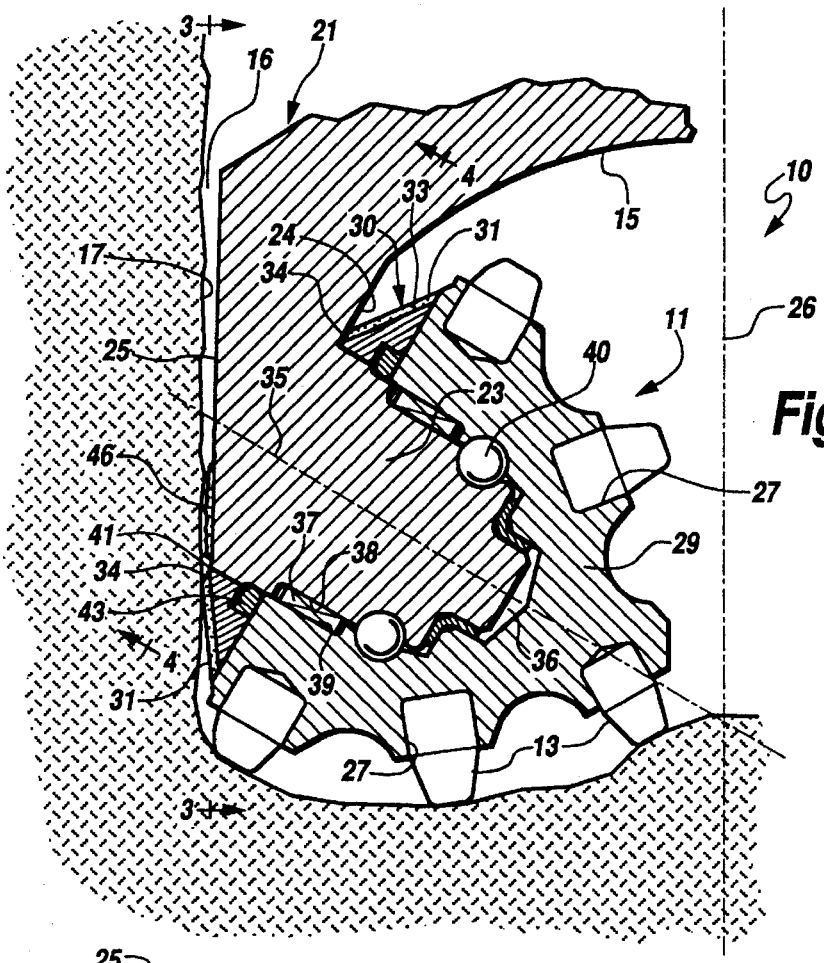
FIG. 2 is an enlarged cross-sectional view with portions broken away showing one of the rotary cone cutters mounted on an arm of the drill bit illustrated in FIG. 1 in drilling engagement with the bottom of a borehole.

As shown in FIG. 2, inserts 13 are mounted within sockets 27 formed in a conically-shaped shell or tip 29 of cutter 11. A base portion 30 of cutter 11 includes a frustoconically-shaped outer portion 33 with grooves 12 formed therein. Outer portion 33 is preferably angled in a direction opposite the angle of tip 29. Base portion 30 may also be referred to as a "backface ring" or "matrix ring." Outer portion 33 of base 30 defines in part backface 31 of cutter 11. Base 30 also includes an end portion 34 extending radially relative to central axis 35 of spindle 23. Base portion 30 and tip 29 cooperate to form composite rotary cone cutter 11.

Opening inwardly of end portion 34 is a generally cylindrical cavity 36 for receiving spindle 23. A suitable bearing 37 is preferably mounted on spindle 23 and engages between a bearing wall 39 of cavity 36 and an annular bearing surface 38 on spindle 23. A conventional ball retaining system 40 secures cutter 11 to spindle 23.

Sealing across a gap 41 (FIGS. 2 and 2A) between an outside wall 42 (FIG. 2A) of spindle 23 and an inside wall 45 (FIG. 2A) of cavity 36 is an elastomer seal 43. Seal 43 is located adjacent the juncture of spindle 23 with support arm 21 and protects against the infiltration of debris from borehole annulus 16 through gap 41 to the space between the relatively-rotating bearing surfaces 38 and 39 of spindle 23 and cutter 11. Such infiltration will eventually result in damage to bearing 37 and malfunction of drill bit 10.

With an opening located adjacent outside surface or shirttail 25 and contiguous with the bottom edge of arm 21, gap 41 is thus open to borehole annulus 16. It is important that the width of gap 41 be kept relatively small and the length of gap 41 between its opening to annulus 16 and seal 43 be kept relatively long so as to reduce the infiltration of debris that may wear against seal 43 as bit 10 rotates.

In accordance with one aspect of the present invention, cutter 11 and support arm 21 are uniquely constructed so base portion 30 of cutter 11 interfits with spindle 23 so that gap 41 extends throughout its length in a direction substantially parallel to spindle axis 35. Specifically, gap 41 includes an outer cylindrical segment 44 (whose direction is indicated by the arc line in FIG. 3), which intersects with shirttail surface 25 and opens upwardly and outwardly from between spindle 23 and cutter 11 into borehole annulus 16. As a result, hard metal disposed adjacent to gap 41 better protects walls 42 and 45 against erosion. The service life of seal 43 and thus bearing 37 is lengthened, particularly over those prior art arrangements having a shirttail tip with an underside that over time, may be exposed by erosion to borehole debris.

To help protect against erosion widening gap 41 by eroding arm 21, the bottom of shirttail 25 adjacent gap 41 may be covered with a layer 46 of conventional hardfacing material. A preferred hardfacing material comprises tungsten carbide particles dispersed within a cobalt, nickel, or iron based alloy matrix, and may be applied using well known fusion welding processes or other suitable techniques.

Figure 2A:
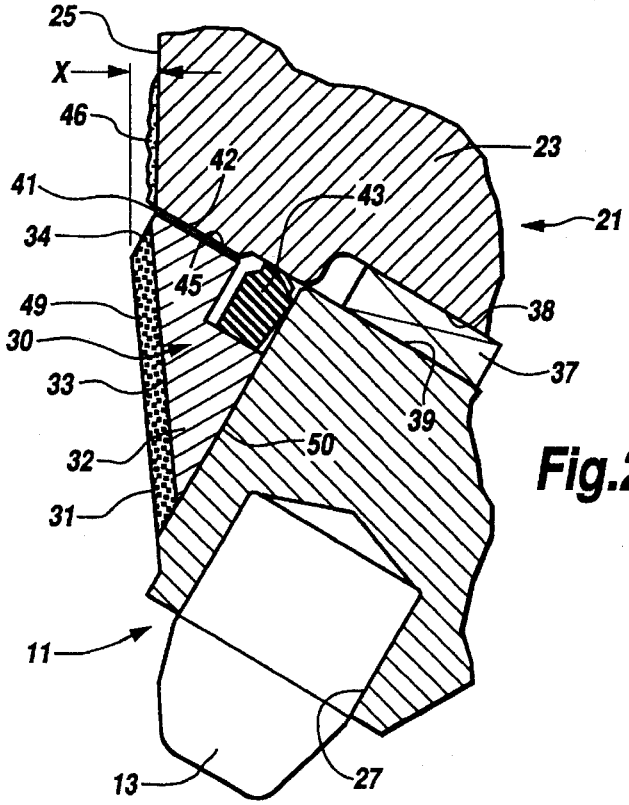
FIG. 2A is a portion of the rotary cone cutter shown in FIG. 2 enlarged for clarity of illustration.
Figure 3:
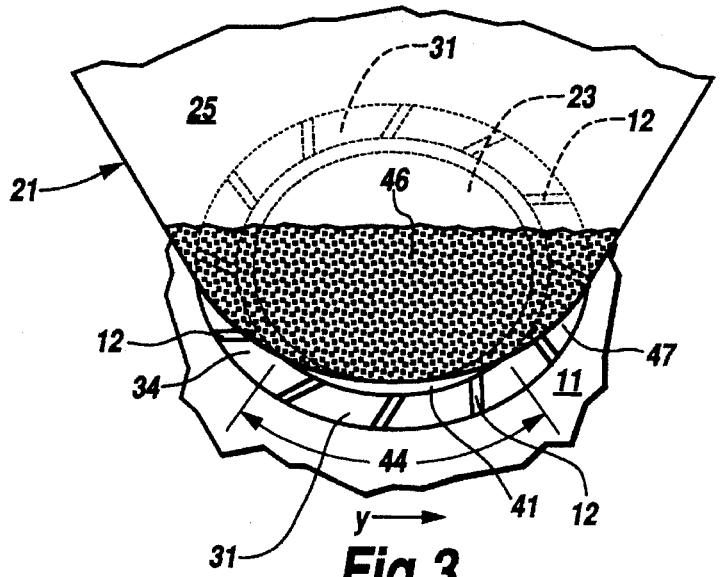
FIG. 3 is an elevational view with portions broken away of the arm and associated rotary cone cutter taken substantially along line 3—3 in FIG. 2.
Figure 4:
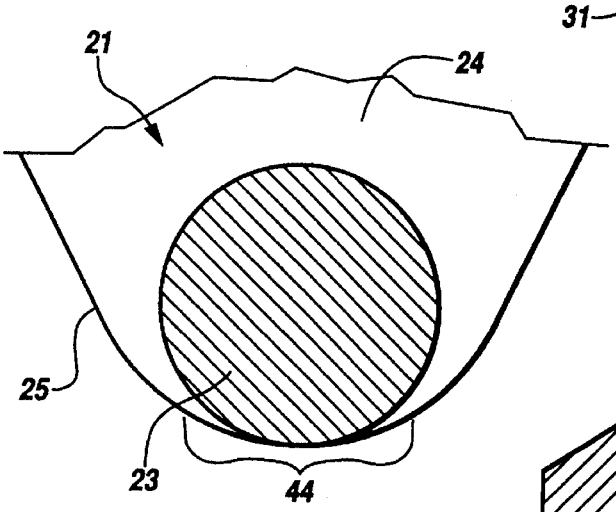
FIG. 4 is cross-sectional view taken substantially along line 4—4 in FIG. 2.

Additional protection against erosion is achieved by spacing outer portion 33 and backface 31 of cutter 11 radially outward a distance X from hardfacing layer 46 (FIG. 2A). Distance X allows backface 31 to deflect the flow of drilling fluid within annulus 16 enough to prevent the fluid from flowing directly into the opening of gap 41. Distance X is a function of the borehole diameter and the bit type (no seal, seal, or double seal), and ranges from 1/16" to 3/16. For the present embodiment, X may be approximately 1/8.

By virtue of this construction, a leading edge portion 47 of shirttail 25 is protected from the impingement of debris carried by the upwardly-flowing drilling fluid. This is illustrated most clearly in FIG. 3, wherein the direction of rotation of bit 10 is indicated by the arrow y and the radially outward spacing X effectively blocks lower end portion 47 of arm 21 from being directly in the path of debris carried by the drilling fluid flow.

For enhanced wearability of backface 31 on the cone side of gap 41, backface 31 is either provided with a hard metal covering or made from hard metal. The hard metal covering which provides backface 31 is shown as layer 49 (FIG. 2A) formed from hardfacing material. Layer 49 is preferably harder than the hardfacing material comprising layer 46, and is attached to outer portion 33 of base 30 without use of a filler material. Specifically, layer 49 comprises a composition of material including tungsten carbide particles surrounded by a matrix of a copper, nickel, iron, or cobalt based alloy that is applied directly to base portion 30 over substantially the entire outer portion 33. Acceptable alternative hardfacing materials include carbides, nitrides, borides, carbonitrides, silicides of tungsten, niobium, vanadium, molybdenum, silicon, titanium, tantalum, hafnium, zirconium, chromium or boron, diamond, diamond composites, carbon nitride, and mixtures thereof. For one application, tungsten carbide particles with the size range given in Table 1 are used to form layer 49.

Preferably, backface ring 30 comprises an infiltrant alloy comprising Mn 25 weight percent, Ni 15 weight percent, Zn 9 weight percent, and Cu 51 weight percent. This alloy has good melt and flow characteristics, and good wettability for both tungsten carbide and steel. A typical hardfacing layer 49 may comprise between 20% and 40% infiltrant alloy by volume.

Techniques for the application of hardfacing layer 49 are well known in the art. One technique is an atomic hydrogen or oxyfuel welding process using a tube material containing ceramic particles in a Ni, Co, Cu or Fe based matrix. A second technique is the Thermal Spray or Plasma Transfer Arc process using powders containing ceramic particles in a Ni, Co, Cu or Fe based matrix. This technique is discussed in U.S. Pat. No. 4,938,991. Both the first and second techniques may be performed either by hand or by robotic welder. A third technique is disclosed in U.S. Pat. No. 3,800,891 (see Columns 7, 8 and 9).

Alternatively, hardfacing layer 49 may be applied by a slurry casting process in which hard particles, such as the alternative hardfacing materials described for the preferred embodiment, are mixed with a molten bath of ferrous alloy. (Alternatively, the molten bath may be of a nickel, cobalt, or copper based alloy.) This mixture is poured into a mold and solidifies into a solid body. If the mold is formed directly on cutter cone 11, the body metallurgically bonds to cutter cone 11 as the body solidifies to form layer 49. Grooves 12 may be molded during the application of hard facing layer 49, or may be cut into layer 49 after it has been applied.

In accordance with perhaps a broader and more important aspect of the present invention as illustrated in the preferred embodiment of FIG. 2, cutter 11 is a composite body with base 30 formed separately from tip 29 and including a nonheat-treatable hard metal component having a higher degree of hardness than found in prior rotary cone cutters. In contrast, conical tip 29 is made of a conventional heat-treated steel. With this construction, backface 31 is better able to withstand both erosion and abrasive wear, thus not only providing enhanced protection of seal 43, but also serving to better maintain the gage diameter of borehole wall 17, particularly when drilling a deviated or horizontal borehole.

In the present instance, shell or tip 29 of cutter 11 may be manufactured of any hardenable steel or other high-strength engineering alloy which has adequate strength, toughness, and wear resistance to withstand the rigors of the downhole application. In the exemplary embodiment, tip 29 is manufactured from a 9315 steel having a core hardness in the heat-treated condition of approximately HRC 30 to 45, and having an ultimate tensile strength of 950 to 1480 MPa (138 to 215 ksi). Other portions of cutter 11, such as precision bearing surfaces 39, may also be formed from this 9315 steel. In producing tip 29, the alloy is heat-treated and quenched in a conventional and well known manner to give tip 29 the desired degree of hardness.

In the illustrated embodiment, base 30 comprises a low-alloy steel core 32 (FIG. 2A) onto which is affixed continuous layer or coating 49 of hard metal. Core 32 may also be referred to as a "matrix ring." (A low-alloy steel has between approximately 2 and 10 weight percent alloy content.) Core 32 is preferably a ring-shaped piece of the same material composition as tip 29, but of less expensive steel alloy which is not quench hardenable such as low carbon steel. In affixing layer 49, the exterior of steel core 32 is machined to size to receive the coating, and placed into a prepared mold (not shown) whose cavity is shaped to provide the desired coating thickness for layer 49.

The prepared mold (not shown) is milled or turned from graphite. Each internal surface that will contact steel core 32 is painted with brazing stop off, such as Wall Colmonoy's Green Stop Off® paint. Also painted are the surfaces of steel core 32 that will not be coated with hardfacing layer 49. Preferably, the mold is designed so that the thermal expansion of steel core 32 will not stress the fragile graphite mold parts.

Steel core 32 is assembled within the painted mold. The hard particles which form hardfacing layer 49 are then distributed within the mold cavity. TABLE 1 shows typical sizes and distribution of the hard particles for the preferred embodiment.

TABLE I

| U.S. Mesh | Weight % |
|---|---|
| +80 | 0–3 |
| −80 +120 | 10–18 |
| −120 +170 | 15–22 |
| −170 +230 | 16–25 |
| −230 +325 | 10–18 |
| −325 | 28–36 |

Next, a vibration is applied to the mold to compact the layer of loose particles within the mold cavity. The infiltrant alloy is then placed in the material distribution basin above the hard particle layer in the cavity. If the infiltration operation is performed in an air furnace, powdered flux is added to protect the alloy. If the operation is performed in a vacuum or protective atmosphere, flux is not required.

In utilizing the mold, tungsten carbide powder or another suitable material is dispersed within the cavity to fill it, and an infiltrant alloy is positioned relative to the mold. Then the infiltrant alloy and the mold are heated within a furnace to a temperature at which the alloy melts and completely infiltrates the mold cavity, causing the carbide particles to bond together and to steel core 32.

Alternatively, base 30 can be made as a casting of composite material comprised of hard particles, such as boron carbide ($B_4C$), silicon nitride ($Si_3N_4$), or silicon carbide (SIC), in a tough ferrous matrix such as a high strength, low alloy steel, or precipitation hardened stainless steel. In the form of fibers or powders, these particles can reinforce such a matrix. This matrix may be formed either by mixing the particles with the molten alloy and casting the resultant slurry, or by making a preform of the particles and allowing the molten alloy to infiltrate the preform. Base 30 may be attached to tip 29 by inertia welding or similar techniques and methods to form composite rotary cone cutter 11.

Once both base 30 (made in a manner other than the above-described composite-material casting process) and tip 29 are made, these two separate parts are joined together in a manner which is substantially non-destructive of the desirable characteristics of each. Preferably, they are joined together along a weld line 50 (see FIG. 2A) utilizing the process of inertia welding wherein one part is held rotationally stationary while the other is rotated at a predetermined speed that generates sufficient localized frictional heat to melt and instantaneously weld the parts together without use of a filler. This process may employ a conventional inertia welding machine that is configured to allow variation of the rotating mass within the limitations of the machine's mass-rotating capacity and to rotate the mass at a controllable and reproducible rate. Once the rotating part is at the predetermined rotational speed, the parts are brought into contact with a predetermined forging force. The rotational speed may be empirically determined with test parts of the same size, alloy, and prejoining condition. Complete deformation allows two planar facing surfaces on the parts being joined to come into contact.

In one example, base 30 having a volume of 4.722 cubic inches and a weight of 1.336 pounds was successfully joined to a tip 29 having a volume of 16.69 cubic inches and a weight of 4.223 pounds using a 44,000 pound axial load and a rotational speed of 2200 rpm.

Figure 5:
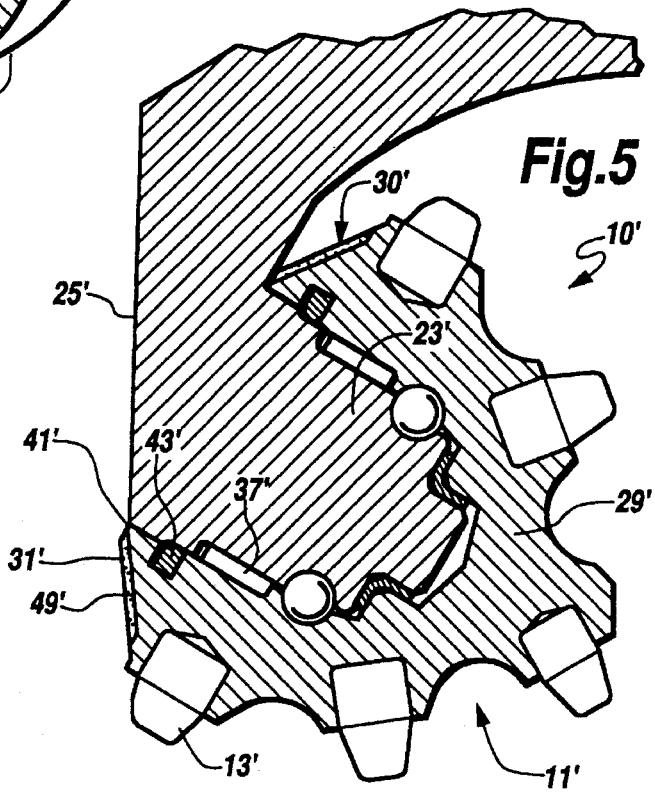
FIG. 5 is a view similar to FIG. 2 showing an alternative embodiment of the present invention.

In an alternate embodiment of the invention shown in FIG. 5 (wherein corresponding parts are identified by the same but primed reference numbers), rotary cone drill bit 10' is made of a conventional alloy steel material and base 30' is integral with tip 29'. Alternative hardfacing materials and composites for layer 49' in the FIG. 5 embodiment include those described above for hardfacing layer 46 of FIGS. 2, 2A and 3 as well as solid oxide ceramics such as alumina or zirconia.

Although the present invention and its advantages have been described in detail, it should be understood that various changes, substitutions and alterations can be made therein without departing from the spirit and scope of the invention as defined by the appended claims.

What is claimed is:

1. A rotary cone drill bit for forming a borehole, said drill bit comprising:

a body with an underside and an upper end portion adapted for connection to a drill string for rotation about a central axis of said body;

a number of angularly-spaced arms integrally formed with said body and depending therefrom, each of said arms having an inside surface with a spindle connected thereto and an outer shirttail surface, said spindle projecting generally downwardly with respect to said body and inwardly with respect to said axis and having a generally cylindrical upper end portion connected to said inside surface and an inner sealing surface on said spindle within said upper end portion;

an outside wall formed on said upper end portion of each of said spindles between said outer shirttail surface and said inner sealing surface;

a plurality of cone cutters equaling said number of arms and mounted respectively on one of said spindles, each of said cone cutters including a generally cylindrical inside wall defining in part a cavity for respectively receiving said spindle such that a generally cylindrical gap is formed between said outside wall of said spindle and said inside wall of said cavity, a portion of said gap adjacent to said outer shirttail surface extending in a direction parallel to a central axis of said spindle and having an outer segment intersecting with said shirttail surface and opening upwardly with respect to said body and outwardly from said shirttail surface, including an outer sealing surface in said cavity concentric with said inner sealing surface, and including a seal element sealing between said inner and outer sealing surfaces; and said gap extending from the exterior of said shirttail surface to said sealing element in said direction parallel with said central axis of said spindle.

2. The drill bit as defined by claim 1 wherein said cutters each include a generally conical cutter body having a base defining a cavity opening and a tip pointed away from said cavity opening, said inside wall extending from said cavity opening in said direction parallel with said central axis of said spindle, an outer portion of said base having a generally frustoconical shape directed away from said tip and surrounding said cavity opening, said outer portion having a circumferentially and radially continuous layer of hard metal material disposed thereon to form a backface.

3. The drill bit as defined by claim 1 wherein said cutters each include a generally conical composite cutter body having a base formed of a conventional steel material with a backface formed of a hard metal material disposed on an outer portion of said base and having a tip formed of a conventional steel material, wherein said hard metal material is incompatible with heat-treating processes for said tip.

4. An arm-cutter assembly of a rotary cone drill bit having a body, the assembly comprising:

an arm integrally formed with the body and having an inner surface, a shirttail surface, and a bottom edge, said inner surface and said shirttail surface contiguous at said bottom edge;

a spindle attached to said inner surface and angled downwardly with respect to said arm;

a portion of said spindle defining an inner sealing surface;

a cutter defining a cavity with an opening for receiving said spindle;

a portion of said cavity defining an outer sealing surface concentric with said inner sealing surface;

a seal for forming a fluid barrier between said inner and outer sealing surfaces;

a gap formed between said cavity and said spindle with said gap extending from said opening in said cavity in a direction substantially parallel to a central axis of said spindle, and said gap having an opening contiguous with said bottom edge; and said gap extending from said bottom edge to said seal in a direction parallel with said central axis of said spindle.

5. The assembly of claim 4 wherein said cutter comprises a generally conical cutter body having a base with a backface disposed on an outer surface thereof, said base extending radially and axially with respect to said spindle such that, proximate said shirttail surface, said backface extends a distance beyond said shirttail surface towards a side wall of said borehole.

6. The assembly of claim 4 wherein a second portion of said cavity comprises an outer bearing surface and a second portion of said spindle comprises an inner beating surface concentric with said outer bearing surface, said seal disposed between said opening and said bearing surfaces.

7. The assembly of claim 4 wherein said cutter includes a generally conical cutter body having a base defining said cavity opening and a tip pointed away from said cavity opening, said inside wall extending from said cavity opening in said direction parallel with said central axis of said spindle, an outer portion of said base having a generally frustoconical shape directed away from said tip and surrounding said cavity opening, said outer portion having a circumferentially and radially continuous layer of hard metal material disposed thereon to form a backface.

8. The assembly of claim 4 wherein said cutter comprises a generally conical composite cutter body having a base portion with a backface and a tip extending therefrom, said tip formed of conventional steel material, said base comprising a core formed of said conventional steel material, said core defining an outer portion of said base, and said backface formed of hard metal material, wherein said hard metal material is incompatible with heat-treating processes for said tip.

9. A rotary cone drill bit for forming a borehole, comprising:

a body with an upper end portion adapted for connection to a drill pipe, for rotating said bit about a central axis of said body;

a number of angularly-spaced arms integrally formed with and depending from said body, each of said arms comprising:

an inside surface;

a spindle having a generally cylindrical end portion connected to said inside surface;

said spindle projecting generally downwardly and inwardly with respect to said central axis;

said end portion having an inner sealing surface thereon; and a shirttail having an outer shirttail surface;

a plurality of cone cutters with each of said cone cutters rotatably mounted on one of said spindles, each of said cutters comprising:

a generally cylindrical inner wall defining a cavity for receiving said spindle, said cavity having an end opening;

an outer sealing surface in said inner wall concentric with said inner sealing surface; and a cutter end portion surrounding said end opening;

a seal element for forming a fluid barrier between said inner and outer sealing surfaces; and a gap formed by said inner wall and said spindle having an opening between said shirttail surface and said cutter end portion such that said gap extends from said end opening in said cavity in a direction substantially parallel with a central axis of said spindle and said gap extending from said end opening to said seal element in said direction parallel to said central axis of said spindle.

10. The rotary cone drill bit as defined by claim 9 wherein each of said cutters further comprises a generally conical cutter body comprising:

a tip pointed away from said cavity opening;

a base, connected to said tip, for partially defining said cavity opening;

said base having a backface surrounding said cavity opening;

said backface having a generally frustoconical shape directed away from said tip; and a circumferentially and radially continuous layer of hard metal material disposed on an outer portion of said base to form said backface.

11. The rotary cone drill bit as defined by claim 9 wherein each of said cutters further comprises a generally conical composite cutter body with a tip formed of a conventional steel material and a base coupled to said tip having a backface formed of a hard metal material, wherein said base comprises a core formed of said conventional steel material, said core defining an outer portion of said base, and wherein said hard metal material is incompatible with heat-treating processes for said tip.

12. The rotary cone drill bit as defined by claim 9 wherein said shirttail surface and said cone cutters have hard metal surfaces adjacent to said opening for said gap to minimize erosion of said shirttail and said cone cutters.

* * * * *